US006357853B1

(12) United States Patent
Askren et al.

(10) Patent No.: US 6,357,853 B1
(45) Date of Patent: Mar. 19, 2002

(54) WASTE INK MANAGEMENT

(75) Inventors: Benjamin Alan Askren, Lexington; John Edward Borsuk, Nicholasville; Donn Duane Bryant, Lexington; Curtis Ray Droege, Richmond; Laura Leigh Garcia, Lexington; Edward Lawrence Kiely, Lexington; Robert Flynt Strean, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/504,652

(22) Filed: Feb. 14, 2000

(51) Int. Cl.[7] ..... B41J 2/165
(52) U.S. Cl. ..... 347/36; 347/31; 347/35
(58) Field of Search ..... 347/36, 35, 34, 347/31, 29, 33

(56) References Cited

U.S. PATENT DOCUMENTS

| | | | | |
|---|---|---|---|---|
| 4,524,365 A | | 6/1985 | Kakeno et al. | |
| 4,701,771 A | | 10/1987 | Ikeda | |
| 4,814,794 A | | 3/1989 | Sato | |
| 5,517,222 A | * | 5/1996 | Sugiyama et al. | 347/35 |
| 5,617,124 A | | 4/1997 | Taylor et al. | |
| 5,680,162 A | * | 10/1997 | Taylor et al. | 347/35 |
| 5,774,142 A | | 6/1998 | Nguyen et al. | |
| 5,821,955 A | | 10/1998 | Waschhauser | |
| 6,168,258 B1 | * | 1/2001 | Lou et al. | 347/33 |
| 6,203,137 B1 | * | 3/2001 | Niimura et al. | 347/36 |

FOREIGN PATENT DOCUMENTS

| | | | | |
|---|---|---|---|---|
| JP | 404028560 A | * | 1/1992 | 347/36 |
| JP | 406071897 A | | 3/1994 | |

OTHER PUBLICATIONS

IBM Corp., "Waste Ink Collector With Overfill Indicator," IBM Technical Disclosure Bulletin, IBM Corp., vol. 29 (No. 11), p. 2, (Apr. 14, 1987).

* cited by examiner

*Primary Examiner*—N. Le
*Assistant Examiner*—Shih-Wen Hsieh
(74) *Attorney, Agent, or Firm*—D. Brent Lambert; Todd T. Taylor

(57) ABSTRACT

A process of, and apparatus for controlling waste ink from an ink jet printer printhead, transfers waste ink to an absorptive diaper, and at least intermittently forces air across the absorptive diaper to promote evaporation of certain volatile ink components from the transferred ink. Waste ink may be received and temporarily retained on a plurality of spaced apart inclined louvers located above the absorptive diaper, and air conveyed across and between the louvers to promote evaporation of certain volatile components from the received ink.

18 Claims, 3 Drawing Sheets

WASTE INK MANAGEMENT

BACKGROUND OF THE INVENTION

1. Field of the Invention

The present invention relates to printers of the ink jet variety and more particularly to a system for concentrating and containing waste ink in such printers.

2. Description of the Related Art

Conventional ink jet printers require a storage device for accumulating waste ink due to printhead maintenance, which requires jetting of ink droplets periodically to clear contamination from nozzles or to ensure proper ink chemistry at the nozzle openings. More recent inks have become more difficult to maintain, due to customer expectations of faster throughput, greater optical density, and less bleeding into the print media. Each of these results in inks which require more jetting to properly maintain the printheads and an associated increase in the quantity of waste ink to be controlled.

A common method of accumulating waste ink is to capture it in an absorbent material (referred hereafter as a diaper) to prevent contamination due to printer orientation. A diaper would normally be placed in an open tray, or some other type of open container. A complete saturation of the diaper causes flooding, or spilling, in a printer that uses diapers in the traditional manner. With the increased waste requirements due to increased throughput and printer life, the volume of felt material can become substantial. As an example, certain commercially available printers have diapers that line nearly the entire bottom surface of the printer. Even so, under certain conditions such as high duty cycle, or duty cycle bursts late in printer life, the probability of waste overflow becomes increasingly high. Further, pigment based inks tend to render absorbent material ineffective due to pigment bridging of the capillary paths. As a result, an alternate technique of managing pigment ink waste is sometimes required.

In many cases, space constraints do not allow for adequate diaper size. For these applications, a diaper is used to perhaps cover an open container to minimize splashing of waste ink in the event the printer is transported. This method can only be used for printers with a relatively short recommended life, thus less waste ink. The uncertainty of actual life, however, in addition to duty cycle uncertainties, renders this method inferior.

Critical to managing ink waste is evaporating the "fast volatiles", such as water, from the ink as efficiently as possible. This reduces the risk of spillage, or overflow, and reduces the volumetric requirements for waste containment. Another critical design element is to provide adequate, but not excessive, volumetric requirements for ink waste.

SUMMARY OF THE INVENTION

The present invention optimizes available and cost effective components that, as a system, maximize evaporation and minimize volumetric waste requirements. Further, the present invention provides a robust method of spillage or overflow containment.

The invention comprises, in one form thereof, a process in which ink jet printer waste ink from a printhead is transferred to a surface across which air is forced to promote evaporation of certain volatile ink components from the ink. The surface may comprise an absorptive diaper.

Also in general, and in one form of the invention, waste ink from an ink jet printer printhead is controlled by depositing the waste ink on a region, exposing the deposited ink to an air flow to promote evaporation of certain volatile ink components, and transferring at least some unevaporated ink from the region to a spill-resistant container.

An advantage of the present invention is an increased waste ink disposal capability with minimum retention capacity requirements.

Another advantage is waste ink confinement with reduced spillage potential.

Yet another advantage is effective waste ink containment by quickly evaporating certain volatile ink components prior to containment, securely retaining the unevaporated components, and allowing for additional evaporation subsequent to containment.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
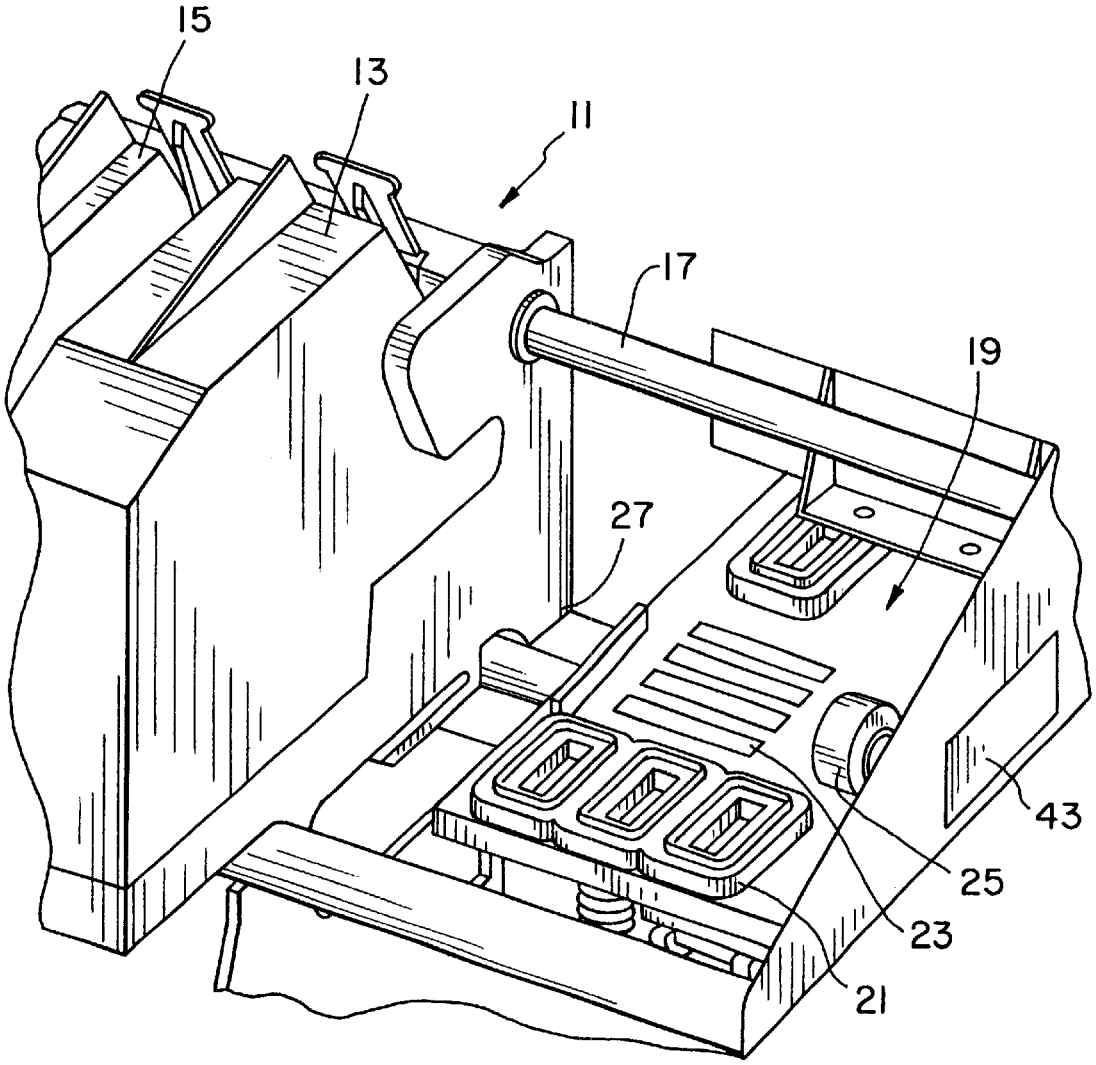
FIG. 1 is a perspective view of a portion of an ink jet printer showing a carriage and improved maintenance station.

Referring now to the drawings and particularly to FIG. 1, there is shown a portion of an ink jet printer having a carriage 11 supporting ink cartridges such as a color cartridge 15 and a 19 black ink cartridge 13 for reciprocable motion along a guide rod 17. During periods of nonuse, carriage 11 assumes a parked position over the service or maintenance station 19 which includes ink caps such as 21, and a series of spaced apart inclined surfaces or louvers 23 and a spit wheel 25, each for receiving and temporarily retaining waste ink from certain of the printheads such as printheads 27 and 28. Portions of the maintenance station are also accessible through the access door 43.

Figure 2:
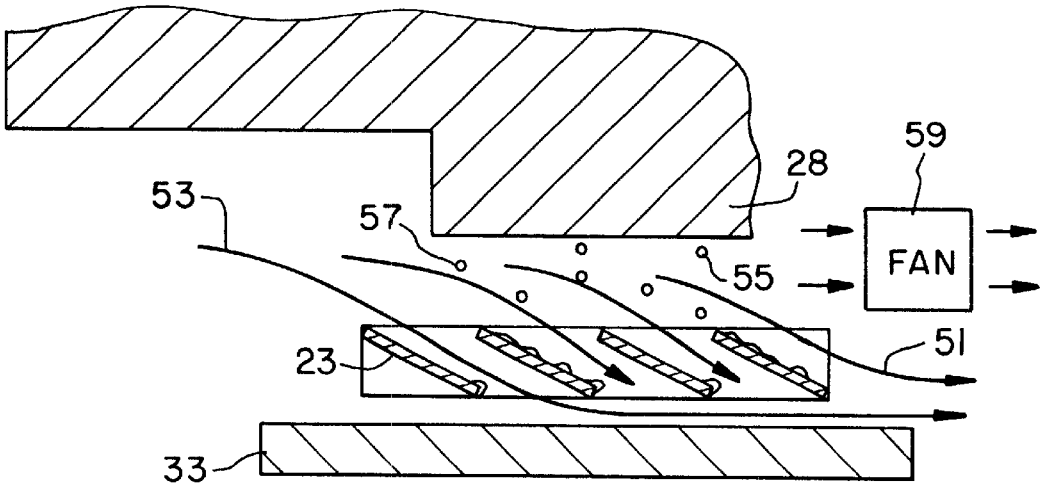
FIG. 2 is a cross-sectional view of a printhead and portions of the maintenance station of FIG. 1.

In FIG. 2, the color ink printhead 28 is shown at the maintenance station superimposed over the louvers 23. Beneath the louvers is an absorptive diaper portion 33 which receives the dye-based color inks dripping from the louvers 23. Fan 59 blows air as illustrated by the arrows 51 and 53, across the louvers and the diaper portion 33 to promote evaporation of some of the more volatile components (frequently water) from the ink. The louvers 23 and horizontal portion 33 of the diaper are also seen in FIG. 3.

Some ink may not be evaporated on the louvers and may drip though as at 61. This ink is deposited on the diaper portion 33 across which air from fan 59 continues to flow promoting further evaporation. If evaporation fails to keep pace with the deposition of waste ink, some ink drains into the sump 34. If the sump is sufficiently filled, the ink will contact the vertical portion 31 of the diaper 29. If the evaporation catches up with the rate of deposition, ink will be wicked up from the reservoir 34 and back to the diaper portion 33 for evaporation. When color ink printhead 28 is disposed over the louvers 23, black ink printhead 27 is located over the spit wheel 25. Printhead 27 may also be purged at the maintenance station with waste ink jetted onto the spit wheel 25. Spit wheel 25 is periodically rotationally incremented and functions to receive and dry the pigment based (black) ink. The dry ink 44 is scraped from the wheel 25 by a scraper 28 and the dried ink deposited in the sump 34 as shown at 45.

Printheads 28 spit ink 55, 57 onto louvers such as 23. Waste ink is held, by surface tension, for evaporation by airflow from fan 59 passing through the louvers as illustrated in FIG. 2 by the arrows 51 and 53. Unlike spit wheel 25, however, no active method of removing ink exists. The dye-based inks used for this application contain humectants and slow volatile solvents—both of which remain in liquid form. Consequently, the fast volatiles, primarily water, evaporate quickly, while the remaining liquid residue resides on the louver surface. Over a number of spit cycles, the slow volatile liquids will coalesce and drip to a diaper 29 below. If the printer duty cycle rate is so great that complete evaporation does not occur, this liquid drips to the diaper without event. Incomplete evaporation at the spit louvers will be referred to as "saturating the louvers". Evaporation on the louvers is enhanced by airflow through them, as shown by arrows 51 and 53 in FIG. 2.

Figure 3:
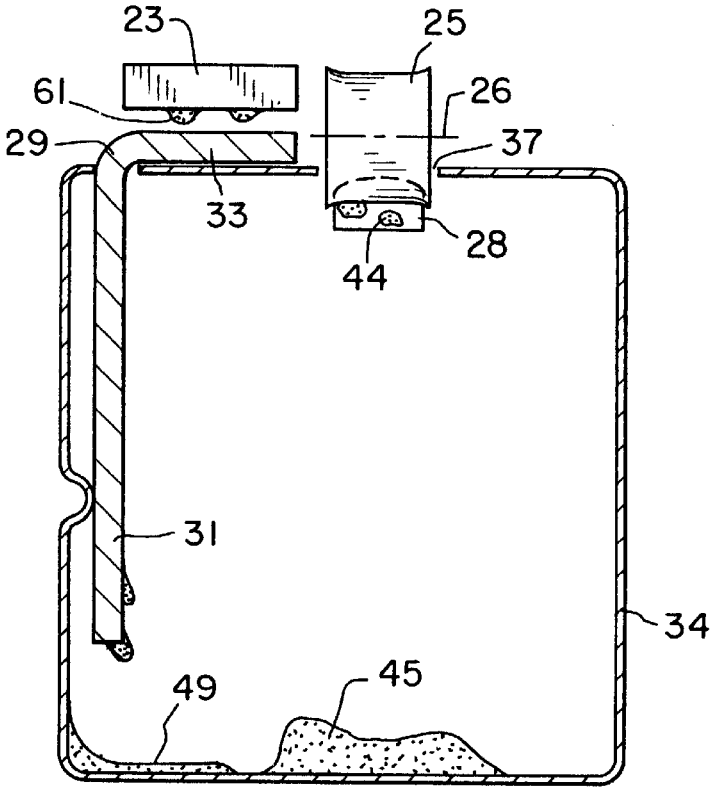
FIG. 3 is a cross-sectional view orthogonal to FIG. 2 showing portions of the maintenance station and a sump for receiving and retaining waste ink.

The diaper is shaped like an inverted "L", as shown in FIG. 3. The horizontal component 33 receives ink from the louvers 23 and distributes it within the diaper. As ink progressively accumulates, the horizontal component 33 will become saturated. During this transition to saturation, the vertical component 31 absorbs ink as well. Over time, the entire diaper may become saturated. If printing intensity decreases, evaporation will free up diaper volume for future saturation cycles. If not, ink will drip into a container 34 as shown at 49.

Figure 4:
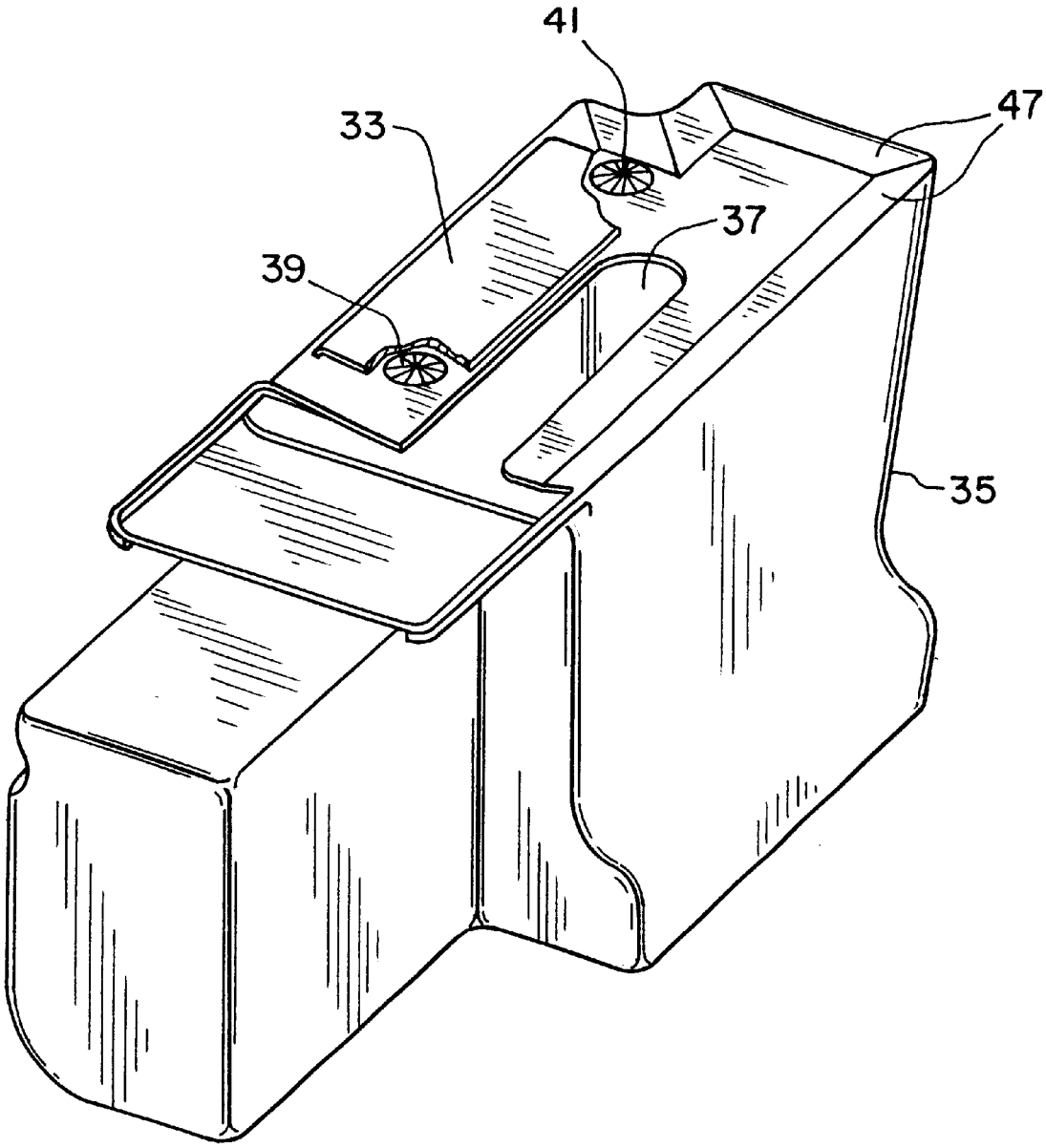
FIG. 4 is a perspective view of a detailed implementation of a waste ink sump.

A more detailed sump or reservoir 35 is shown in FIG. 4 where transverse diaper portion 33 is surrounded by the spill lip 47 which forms the reservoir top into a tray to prevent spillage from the reservoir top. A pair of drain holes 39 and 41 convey excess ink to the reservoir interior. Slot 37 accepts the lower portion of the spit wheel 25 as illustrated in FIG. 3. The reservoir of FIG. 4 comprises a spill proof container 35 with integrated diaper 29. The container, or sump, is a single blow molded component that is closed on all sides except for the cutouts such as 37 shown on top. Spill lips 47 around the perimeter prevent spillage from ink on the top surface if the printer is tilted. Note that the diaper, as well as drain holes 39 and 41, minimizes the volume of ink on this surface, even in high duty cycle applications. The same spill lip acts to retain fluid inside the container as well.

The method of operation of the present invention should now be clear. Three stages of operation are involved. In the first stage, evaporation occurs prior to containment of the waste ink. Evaporation prior to containment uses two methods. For pigment-based (Black) ink, the printhead 27 spits or purges waste ink over a spit wheel 25, as shown in FIGS. 1 and 3. The effective surface tension of the wheel 25 holds the ink in place without runoff and dripping. The wheel is indexed about axis 26 periodically to present the ink, which is assumed to be dry, to a scraper 28 positioned in the bottom quadrant of the wheel. The scraper 28 removes the dry ink, which is then deposited to the bottom of the waste container 34 as shown at 45.

The second method of evaporation prior to containment focuses on dye-based (color) inks. As waste fluid ink progressively fills the sump 35, it contacts the diaper vertical portion 31. The diaper wicks the fluid to the areas of lowest ink saturation, which will be the horizontal portion 33 during periods of low printer activity. This will present the fluid to air currents 53, which will quickly evaporate the fast volatiles that were contained during periods of high printer activity. Thus, the diaper 29 serves a dual evaporation purpose: First, it evaporates the fast volatiles before entering the sump. Second, it evaporates the fast volatiles which were contained before evaporation could occur (high duty cycles).

The second stage, evaporation during containment, is accomplished by the diaper 29 which is positioned directly beneath the spit louvers 23. Ink coalescing on the louvers, and subsequently dripping onto the diaper, effectively initiates stage two. The diaper absorbs the ink, and distributes it for maximum surface area contact. Absorption of all liquid is ideal, as potential spillage is eliminated. Maximum surface area contact provides enhanced evaporation. For printing applications in which duty cycles are sufficient to saturate the louvers, the diaper offers a second opportunity. Ink will drip into a container 34 as shown at 49. This initiates phase three, spill-proof containment.

The diaper 29 behaves much the same way as traditional diapers. That is, the diaper will absorb, then evaporate, liquid ink. Times of high duty cycles will saturate the diaper, then evaporate during periods of less intense printer activity. (Each saturation, and subsequent evaporation, is referred to as a "saturation cycle".) Local saturation of the diaper may also occur. With each saturation cycle, however, a loss of ink absorption efficiency occurs. As a result, ink must migrate progressively from the point of origin to the boundaries of the diaper to be absorbed. Although saturation may occur, evaporation will free up diaper capacity if given enough time. Evaporation from the diaper is enhanced by airflow over the horizontal surface 33 of the diaper, as well as through the louvers 23.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A process of controlling waste ink from an ink jet printer printhead, comprising the steps of:

transferring waste ink from at least one fixed, inclined surface to an absorptive diaper;

continuously forcing air across the absorptive diaper to promote evaporation of certain volatile ink components from the transferred ink;

transferring at least some unevaporated ink from the diaper to a spill-resistant container;

returning at least part of the transferred ink to the absorptive diaper; and continuing to force air across the absorptive diaper to promote evaporation of certain volatile ink components from the returned ink.

2. The process of claim 1, wherein the step of transferring is performed during periods of heavy printer usage while the step of returning is performed during periods of little printer usage.

3. A process of controlling waste ink from an ink jet printer printhead, depositing the waste ink on a first region;

exposing the deposited ink to an air flow to promote evaporation of certain volatile ink components;

dripping unevaporated ink from the first region on a second region and exposing the second region to air flow to further evaporate volatile components; and transferring at least some unevaporated ink from the second region to a spill-resistant container.

4. The process of claim 3 including the additional step of continuing to evaporate volatile ink components from the transferred ink.

5. The process of claim 4 wherein the step of continuing includes wicking the transferred ink from the container back to the second region.

6. A process of confining and concentrating waste ink from an inkjet printer printhead, comprising the steps of:

receiving and temporarily retaining waste ink on a plurality of spaced apart inclined louvers; and conveying air across and between the louvers to promote evaporation of certain volatile components from the received ink.

7. The process of claim 6 including the additional steps of transferring unevaporated ink from the louvers to an absorptive layer located beneath the louvers, and exposing the absorptive pad to air flow to further evaporate volatile components.

8. A system for confining and concentrating waste ink purged from at least one ink jet printhead, comprising:

at least one inclined surface for receiving and temporarily retaining waste ink;

an air source for conveying air across the at least one inclined surface to promote evaporation of certain volatile components from the received ink; and a container positioned beneath the at least one inclined surface for receiving and retaining unevaporated ink components from the at least one inclined surface.

9. The improvement of claim 8 further comprising an absorbent diaper for receiving and temporarily retaining the waste ink from the inclined surfaces, said air source conveying air across said diaper.

10. A system for confining and concentrating waste ink purged from at least one ink jet printhead, comprising:

a plurality of spaced apart inclined surfaces for receiving and temporarily retaining waste ink;

an air source for conveying air across the inclined surfaces to promote evaporation of certain volatile components from the received ink; and a container positioned beneath the inclined surfaces for receiving and retaining unevaporated ink components from the inclined surfaces.

11. A system for confining and concentrating waste ink purged from at least one ink jet printhead, comprising:

at least one inclined surface for receiving and temporarily retaining waste ink;

an air source for conveying air across the at least one inclined surface to promote evaporation of certain volatile components from the received ink;

a container positioned beneath the at least one inclined surface for receiving and retaining unevaporated ink components from the at least one inclined surface; and an absorbent diaper for receiving and temporarily retaining the waste ink from the inclined surfaces, said air source conveying air across said diaper, the absorbent diaper including an upper portion and a downwardly depending portion extending into the container for transferring unevaporated ink from the container back to the upper portion to be exposed to the conveyed air.

12. A system for confining and concentrating waste ink purged from at least one ink jet printhead, comprising:

a plurality of spaced apart inclined surfaces for receiving and temporarily retaining the waste ink;

an air source for conveying air across the inclined surfaces to promote evaporation of certain volatile components from the received ink;

a container positioned beneath the inclined surfaces for receiving and retaining unevaporated ink components from the inclined surfaces; and an absorbent pad located intermediate between the container and the inclined surfaces for receiving unevaporated ink from the inclined surfaces.

13. An ink jet printer having at least one printhead and a maintenance station to which the printhead may be moved and waste ink removed, the maintenance station comprising a spill-resistant waste ink reservoir having a top wall with:

an upper ink receiving surface completely peripherally bounded by raised spill lips; and at least one opening for conveying waste ink from the surface to the reservoir interior.

14. The maintenance station improvement of claim 13 wherein the top wall of the reservoir further includes a second opening receiving a portion of a rotatable spit wheel, the spit wheel being adapted to receive and dry certain ink materials, and a scraper within the reservoir and adjacent the spit wheel for removing dry ink to be deposited within the reservoir.

15. A waste ink desiccating system comprising:

a first region including at least one louver on which waste ink may be deposited;

an air source for facilitating the evaporation of volatile components from the deposited ink;

a second region disposed beneath the first region for receiving unevaporated ink from the first region, the air source continuing to facilitate the evaporation of volatile components from the received ink; and a spill-resistant reservoir disposed beneath the second region for receiving unevaporated ink from the second region.

16. A waste ink desiccating system comprising:

a plurality of spaced apart generally parallel louvers on which waste ink may be deposited;

an air source for facilitating the evaporation of volatile components from the deposited ink;

an absorbent diaper disposed beneath the louvers for receiving unevaporated ink from the louvers, the air source continuing to facilitate the evaporation volatile components from the received ink; and a spill-resistant reservoir disposed beneath the diaper for receiving unevaporated ink from the diaper.

17. The waste ink desiccating system of claim 16 wherein the absorbent diaper includes a generally vertical portion extending from the second region into the spill-resistant reservoir to retrieve ink from the reservoir for exposure to air flow from the air source.

18. The waste ink desiccating system of claim 17 wherein the air source comprises a forced air source for conveying air across and between the louvers to promote evaporation of certain volatile components from the deposited ink, and certain ones of the parallel louvers direct air passing through the louvers to the absorbent diaper.

* * * * *